US005581816A

United States Patent [19]

Davis

[11] Patent Number: 5,581,816

[45] Date of Patent: Dec. 10, 1996

[54] HEAD AND NECK PROTECTIVE APPARATUS

[76] Inventor: Emsley A. Davis, 1805 Park La., Wellington, Tex. 79095

[21] Appl. No.: 157,831

[22] Filed: Nov. 24, 1993

[51] Int. Cl.[6] ..... A63B 71/10; A42B 3/14

[52] U.S. Cl. ..... 2/416; 2/421; 2/422; 2/425; 2/410

[58] Field of Search ..... 2/2, 2.12, 2.14, 2/2.15, 410, 6.1, 6.2, 6.6, 415, 417, 420, 421, 423, 44, 45, 416, 419, 422

[56] References Cited

U.S. PATENT DOCUMENTS 2,861,271 11/1958 Lee et al. ..... 2/461
2,892,194 4/1959 Lee et al. ..... 2/461

FOREIGN PATENT DOCUMENTS 87910 9/1959 Denmark ..... 2/416

*Primary Examiner*—Andy Falik
*Assistant Examiner*—Larry D. Worrell, Jr.
*Attorney, Agent, or Firm*—Geoffrey A. Mantooth

[57] ABSTRACT

A protective apparatus has a helmet and shoulder pads. The helmet is coupled to the shoulder pads by a rear support and lateral supports. The rear support is coupled to the shoulder pads by a ball and socket joint. The lateral supports have rollers which are received by channels formed in the shoulder pads. Impacts to the helmet are transmitted to the shoulder pads by the supports. The helmet can move from side-to-side with respect to the shoulder pads by the lateral support rollers traversing the channels, and up and down by the rear support ball and socket joint. Inside of the helmet is a crown that has inner and outer bands. The outer band is pivotally coupled to the helmet so as to allow the head to move up and down within the helmet. The inner band is located within the outer band and rotates within the outer band so as to allow the head to move from side-to-side within the helmet.

15 Claims, 5 Drawing Sheets

HEAD AND NECK PROTECTIVE APPARATUS

FIELD OF THE INVENTION

The present invention relates to apparatuses for protecting the head and neck of a human, which such apparatuses can be used in sporting events, such as football or motorcycling, as well as in industrial and military environments.

BACKGROUND OF THE INVENTION

In sporting activities, such as football, players wear much protective equipment. For example, a player wears a helmet, to protect the head, and shoulder pads, to protect the shoulders. In spite of this equipment, players continue to be injured. For example, in college football over a seven year period from 1975 to 1982, there were 1005 game related concussions reported.

This lack of protection applies to other sports as well. For example, every year, bicycling causes thousands of emergency room visits and a thousand or so deaths. A common cause of death to a bicycle rider is head and neck injuries.

The mechanisms of these head and neck injuries, whether they are caused by football, bicycling, or some other activity, include hyperextension compression of the neck, axial loading of the neck, hyperflexion of the neck, and helmet enhanced inertia injuries of the head.

One cause of these type of injuries is the fact that the head is allowed to move relative to the rest of the body. When the head sustains an impact (regardless of whether a helmet is being worn) some movement of the head relative to the body is incurred. If the player anticipates the impact, then the player can brace his or her body by tightening neck and shoulder muscles. However, if the impact is unanticipated or if the impact is large, then the player's head may move considerably with respect to the body, causing the player to sustain injury to the neck, head and even shoulders.

In sports, mobility of the head and other body portions is greatly prized. What is needed is an apparatus that protects the head and neck of a human, while permitting the head some degree of mobility.

SUMMARY OF THE INVENTION

It is an object of the present invention to provide an apparatus that protects the head and neck of a human from injury due to participation in activities such as sports and the like.

It is another object of the present invention to provide a protective apparatus for the head and neck of a human, which apparatus allows some movement of the head.

In one aspect of the present invention, the protective apparatus, which is for use by a human, includes a helmet and shoulder pads. The helmet has sides and a rear. The shoulder pads have a track coupled thereto. A lateral support is located on each side of the helmet. Each of the lateral supports has a first end and a second end. Each of the lateral support first ends is coupled to the helmet and each of the lateral support second ends is located in the track in the shoulder pads. There is also provided a rear support that has first and second ends. The rear support first end is coupled to the rear of the helmet, while the rear support second end is coupled to the shoulder pads by way of a ball and socket joint.

The protective apparatus of the present invention couples the helmet to the shoulder pads by rear and lateral supports so that an impact that is directed to the helmet is transmitted to the shoulder pads. Thus, head and neck injuries are reduced.

The protective apparatus of the present invention allows the helmet to be moved relative to the shoulder pads in a side to side movement or an up and down movement. Side to side movement of the helmet is provided by the rollers on the ends of the lateral supports. The rollers move within channels that are in the shoulder pads. Up and down movement of the helmet is provided by the ball and socket joint that couples the rear support to the shoulder pads.

In another aspect of the present invention, there is provided a first strap coupled to the first shoulder pad second end and a second strap coupled to the second shoulder pad second end. The first and second straps are coupled together by a buckle.

In accordance with another aspect of the present invention, the protective apparatus includes a helmet and shoulder pads. The shoulder pads have a first shoulder pad and a second shoulder pad, with the first and second shoulder pads forming a neck opening. The first and second shoulder pads each have a channel located therein, with each of the channel extending around a portion of the neck opening. Each of the shoulder pads has first and second ends. The shoulder pad first ends are coupled together. A support is located on each side of the helmet. Each of the supports has a first end and a second end, with each of the support first ends being coupled to the helmet. Each of the support second ends is coupled to a roller, with the roller being located in one of the channels in the shoulder pads.

In still another aspect of the present invention, each channel is located in a channel block. Each channel block is coupled to a shoulder pad.

In still another aspect of the present invention, the protective apparatus includes a helmet which has a shell. A crown is located inside of the helmet. The crown includes a headband and a top piece. The top piece is structured and arranged to fit on a top of a head of a human. The headband has two pins extending outwardly therefrom. Each of the pins has an outer end. Each of the pins extends through one of the side walls of the shell such that the shell is located between the outer end of each pin and the headband. A retainer fits onto the outer end of each pin, wherein the pins allow the headband to pivot within the shell. Such a pivoting movement allows the head of a human to move up and down within the helmet.

In still another aspect of the present invention, the protective apparatus includes a helmet and a crown. The crown includes an inner band and an outer band. Each of the bands form a loop, with the outer band being coupled to the shell. The inner band is located within the outer band. The inner band is rotatably coupled to the outer band.

In still another aspect of the present invention, the inner band is rotatably coupled to the outer band by a projection and slot arrangement. One of the inner or outer bands includes a guide slot that extends circumferentially around a portion of the one inner or outer band. The other of the inner or outer bands has a projection extending therefrom and through the slot, wherein the projection moves within the guide slot when the inner band moves relative to the outer band. The projection and slot arrangement allows the head of a wearer to move side to side within the helmet.

In still another aspect of the present invention, there is provided a spring having two ends and a middle portion.

Each end of the spring is coupled to the one of the inner or outer bands having the guide slot at a location near the ends of the guide slot. The spring middle portion is coupled to the projection. The spring causes the inner band to return to a home position relative to the outer band whenever the inner band is moved out of the home position.

DESCRIPTION OF THE PREFERRED EMBODIMENT

Figure 1:
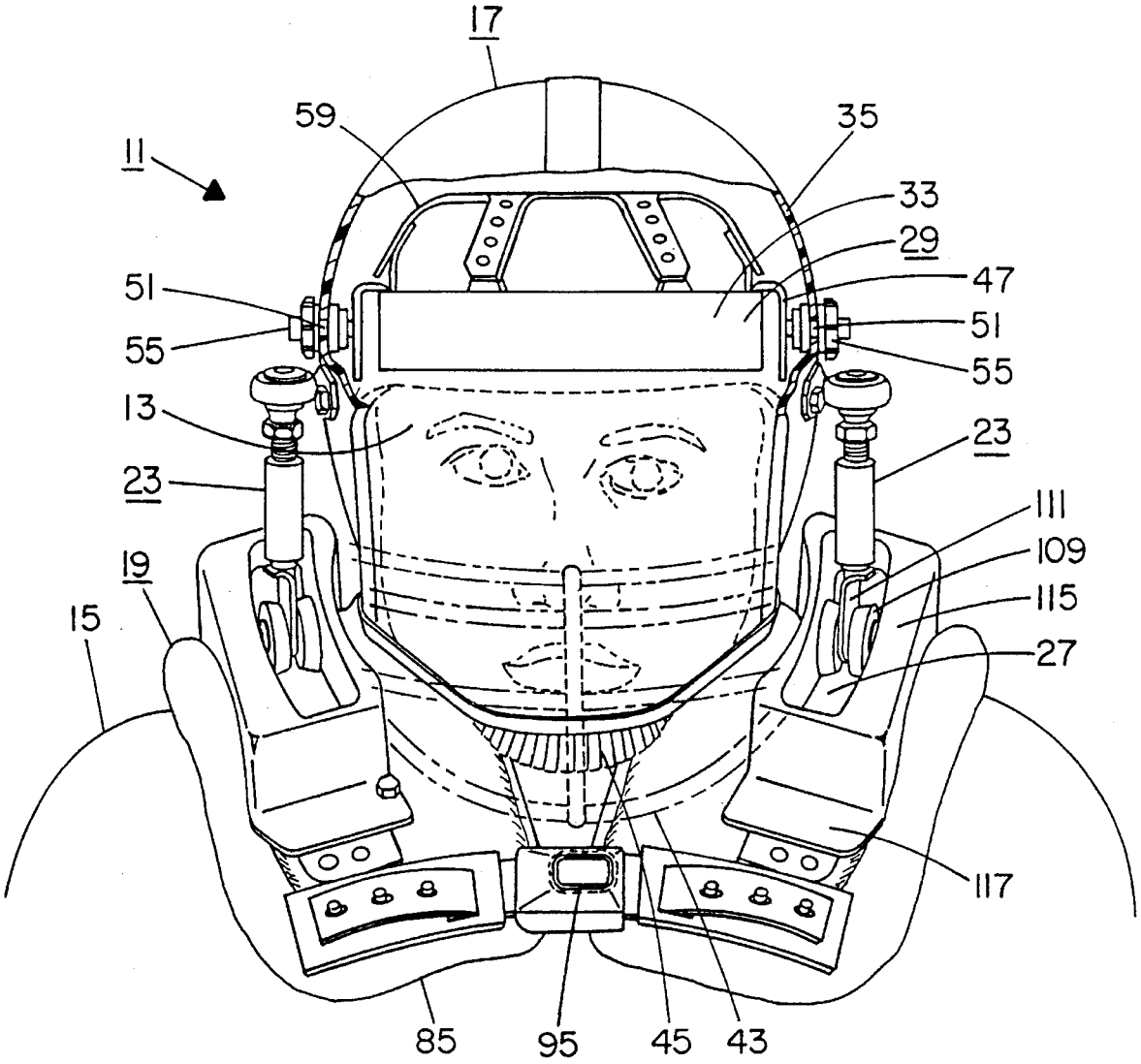
FIG. 1 is a front view of the apparatus of the present invention, in accordance with a preferred embodiment, shown with a human face and portions of a face mask in dashed lines. Portions of the helmet are cut away to illustrate the crown located therein.

In FIG. 1, there is shown a front view of the protective apparatus 11 of the present invention, in accordance with a preferred embodiment. The protective apparatus 11 protects the head 13 (shown by dashed lines in FIG. 1), neck and shoulders 15 of a human when worn. The apparatus 11 includes a helmet 17 and shoulder protection in the form of shoulder pads 19. The helmet 17 is coupled to the shoulder pads by way of supports 21, 23. There is a rear support 21 (see FIG. 4), and two lateral supports 23 (see FIG. 1).

If the helmet 17 sustains an impact, then the protective apparatus 11 of the present invention transfers the impact to the shoulders 15 by way of the supports 21, 23 and the shoulder pads 19. The shoulders are better suited for withstanding such impacts. Thus, the supports 21, 23 effectively integrate the helmet 11 and the shoulder pads 19 into one unit to protect the head and neck.

Movement of the helmet 17 (and the head 13) relative to the shoulder pads 19 (and the shoulders 15) is provided by the supports 21, 23. The bottom ends 25 (see FIG. 3) of the lateral supports 23 allow the helmet 17 to move in a side-to-side fashion relative to the shoulder pads 19. The bottom ends 25 have rollers 113 that move in channels 27 in the shoulder pads 19. Up and down movement of the helmet 17 relative to the shoulder pads 19 is also permitted by a ball and socket joint 28 coupling the rear support 21 to the shoulder pads 19 (see FIG. 4).

Movement of the head 13 inside of the helmet 17 is also provided by a crown 29 (see FIGS. 5 and 6) located inside of the helmet 17. The crown 29 has two concentric bands, namely an inner band 31 that contacts the head and an outer band 33 that is pivotally coupled to the helmet. The head can move side-to-side within the helmet because the inner band 31 of the crown rotates within the outer band 33. In addition, the head can move up and down within the helmet because the outer band 33 pivots within the helmet 17 on pins 53.

The protective apparatus 11 of the present invention will now be described in more detail, beginning with the helmet 17.

Figure 4:
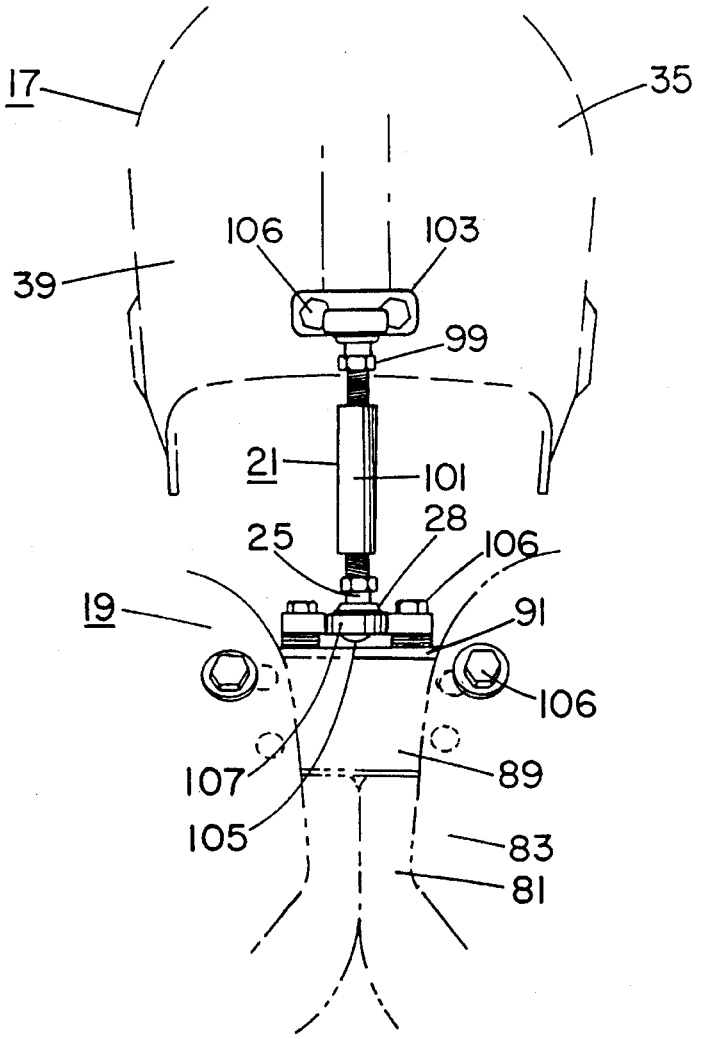
FIG. 4 is a rear close up view of the helmet and rear support as shown coupled to the shoulder pads.
Figure 5:
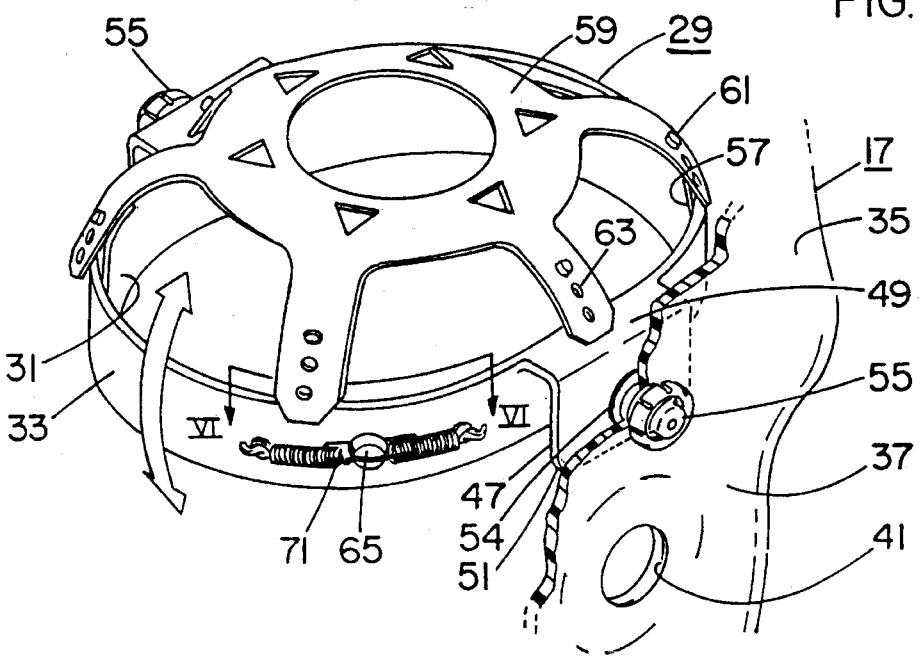
FIG. 5 is a cut away isometric view of the left side of the helmet, showing the crown.

Referring to FIGS. 1 and 5, the helmet 17 includes a shell 35 and the crown 29. The shell 35 is made of a hard plastic that is formed to fit around the head 13. The shell covers the top of the head 13, the forehead, the rear of the head and the sides of the head (including the ears). The shell 35 has side walls 37 (see FIG. 3) and a rear wall 39 (see FIG. 4). Openings 41 (see FIG. 3) are provided in the side walls 37 of the shell so as to allow sound to pass through to the ears. In the preferred embodiment, the shell 35 is a conventional commercially available football helmet. The helmet has a face mask 43 (shown by dashed lines in FIG. 1) and a chip strap 45. The conventional helmet is modified with the provision of the crown 29 and the supports 21, 23. The helmet need not be a football helmet, but may be of a type more suited for the particular activity at hand.

Figure 6:
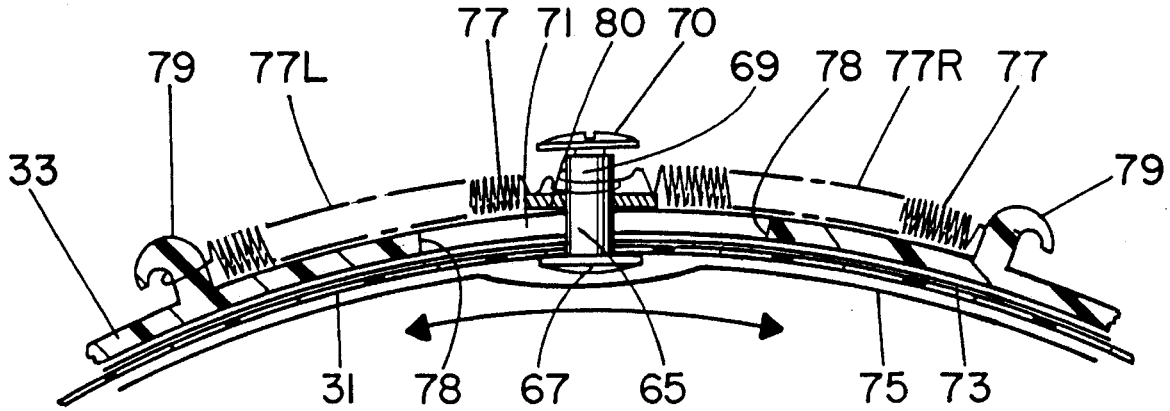
FIG. 6 is a cross-sectional view of a portion of the crown, taken along lines VI—VI of FIG. 5.

The crown 29 is shown in FIGS. 5 and 6. The crown includes the inner band 31 and the outer band 33, both of which form closed loops. The outer band 33 is somewhat elliptical in shape. The lateral portions of the outer band are provided with integral flaps 47 for coupling to the shell 35. Each flap 47 has a spacer portion 49 that extends perpendicularly out from the outer band 33 and a generally flat coupling portion 51 that extends perpendicularly from the spacer portion 49. The coupling portion 51 is located adjacent to an inner surface of the shell 35. A pin 53 (see FIG. 1) is secured to each coupling portion 51 so as to extend outwardly from the coupling portion. The pin may be a bolt. Each pin is received by an opening in the shell 35. Each opening is located in the side wall 37 of the shell, just above the ear opening 41. One or more washers 54 may be located on the pin 53 between the coupling portion 51 and the shell 35. A retainer 55, such as a nut, is secured to the free end of the pin 53 to secure the crown 29 inside of the helmet 17. The retainer 55 may be threaded to receive the threaded end of the pin.

With the outer band 33 installed into the shell by the pins 53, the outer band can pivot up and down within the shell 35 about an axis along the longitudinal axis of the pins. The flaps 47 space the outer band 33 from the shell 35, so as to provide room for movement of the crown within the shell. Thus, the head is not located immediately adjacent to the shell, but is protected by a space. Padding, such as foam inserts, can be provided between the head and the shell to further protect the head.

The inner band 31 is the same shape as the outer band 33 and is concentrically located within the outer band. The inner band is flexible. This allows the somewhat noncircular inner band to rotate within the noncircular outer band. The inner band 31 has tabs 57 that extend upwardly. A top piece 59 is coupled to the tabs 57. Each tab has a projection 61 extending therefrom. These projections are received by one of several openings 63 on the top piece. The top piece 59 has a circular portion with radial arms extending outwardly therefrom. Each arm has a plural number of the openings 63 therethrough to provide for adjustment in fitting the top piece on the head. The top piece 59 and the inner band 31 are in contact with the head.

The coupling of the inner band 31 to the outer band 33 will now be described. Referring to FIG. 6, the inner band 31 has pins 65 projecting outwardly therefrom. In the preferred embodiment, there are two diametrically opposed pins 65 (one in the front portion of the crown (relative to the wearer's head) and the other in the back portion). However, more than two pins 65 can be provided. An inner end 67 of each pin is coupled to the inner band, while the outer end 69 of each pin extends through a slot 71 in the outer band 33. Each slot 71 extends in a circumferential direction on the outer band. The pin and slot arrangement 65, 71 couple the inner band 31 inside of the outer band 33, while allowing the inner band to move with respect to the outer band.

The inner end 67 of each pin 65 can be coupled to the inner band 31 in many ways. In the preferred embodiment, the inner end 67 is provided with a head. The inner band 31 is made up of a core band 73 and an exterior wrapper 75. The wrapper 75, which is soft, covers a portion of the core band and comes in contact with the head. The pin 65 extends through the core band 73, with the core band interposed between the head of the inner end 67 and the outer band 33. The head of the inner end 67 is interposed between the core band 73 and the inner portion of the wrapper 75. Thus, the head of the pin does not contact the human head. The pin 65 also extends through the slot 71 in the outer band 33. An outer head 70 is secured to the outer end 69 of the pin, so as to retain the pin within the slot. The outer head is threaded into the pin, so as to be removeable for assembly of the crown. The pin extends some distance out from the outer band. A spring 77 is coupled to the pin 65 at a location exteriorly of the outer band 33. In the preferred embodiment, the spring 77 is made up of two coil springs, each of which has one end coupled to the pin 65 and the other end coupled to a projection anchor 79. The anchors 79 are located circumferentially from the pin 65. Thus, each spring 77 extends from the pin 65, beyond an end 78 of the slot 71, to the respective anchor 79. A washer 80 is located on the pin, between the springs 77 and the outer band 33.

As the inner band 31 moves within the outer band 33, each pin 65 moves within its respective slot 71. The pin and slot arrangement constrain the movement of the inner band so that the inner band remains concentric and coplanar within the outer band. Movement of the inner band relative to the outer band is limited by the length of the slots 71 (measured between ends 78). The pin 65 and spring 77 arrangement cause the inner band to return to a "home" position after movement, wherein each pin 65 is centered within its respective slot 71 between the ends 78. For example, referring to the orientation of FIG. 6, if the inner band 31 is moved counterclockwise relative to the outer band 33, then the right spring 77R is stretched. When the turning force acting on the inner band is removed, the right spring 77R pulls the inner band back to its original position (shown in FIG. 6). The left spring 77L prevents or minimizes overshoot of the inner band from the home position.

Figure 2:
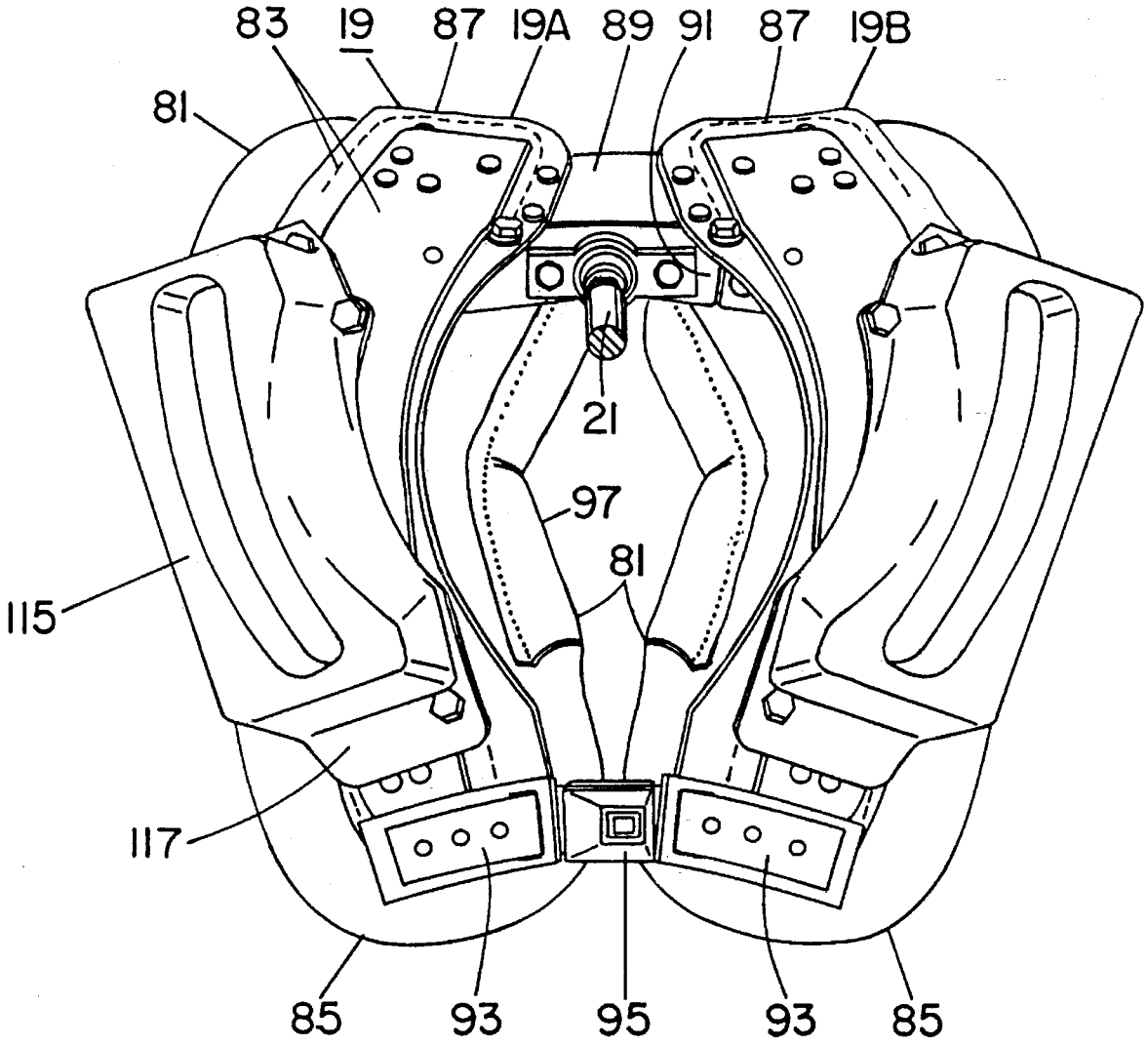
FIG. 2 is a top view of the shoulder pads of the present invention.

The shoulder pads 19 will now be discussed. Referring to FIG. 2, the shoulder pads 19 include a pad 19A, 19B for each shoulder. Each pad 19A, 19B has a soft cushion or pad 81 that contacts the shoulders 15 and a hard plastic backing layer or layers 83. The shoulder pads 19 are conventional and commercially available football pads, but with modifications thereto. Additional pads may be added to the shoulder pads shown in the figures. Such additional pads may offer additional shoulder protection.

Each shoulder pad 19A, 19B has a front end 85 and a rear end 87, corresponding to the orientation of the wearer. The shoulder pads are coupled together at their rear ends 87 with a strap 89 (see also FIG. 4). In addition, a bar 91 is provided across the rear ends 87. The strap 89 and the bar 91 are coupled to the shoulder pads by way of fasteners 106, such as bolts and nuts, that extend through the backing layer 83. The front ends 85 of the shoulder pads are coupled together by straps 93 and a buckle 95. The ends of the straps 93 are riveted to the front ends 85 of the shoulder pad backing layers 83. The buckle 95 is of the quick release type (such as a vehicle seat belt buckle) and allows the straps 93 to be released (and secured) for donning and doffing the shoulder pads. As an alternative to the buckle and straps, laces can be used to couple the front ends of the shoulder pads. The shoulder pads have an opening 97 therein for receiving the wearer's neck.

Figure 3:
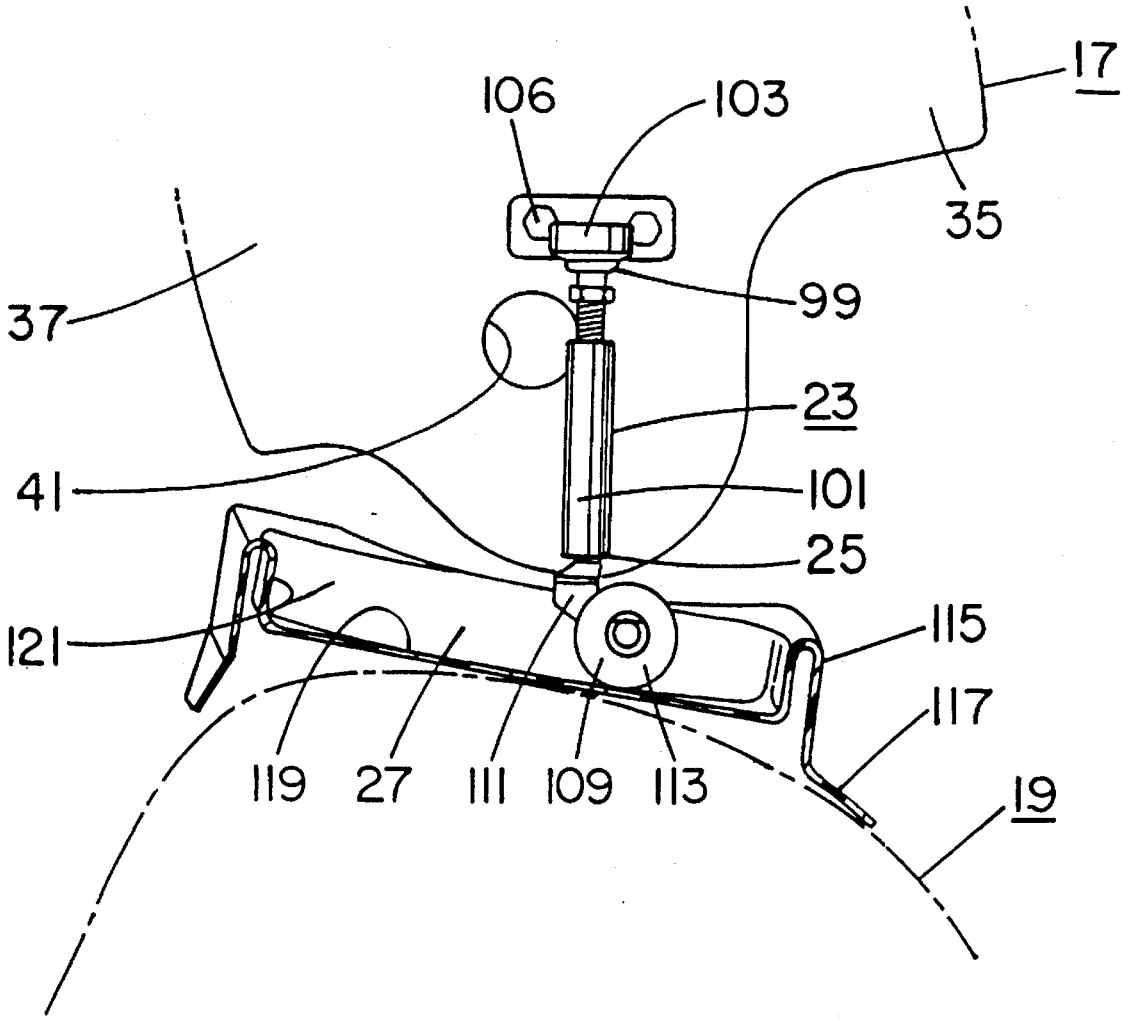
FIG. 3 is a side view of the helmet and channel block, showing the channel block in cross-section.

Referring to FIGS. 3 and 4, the supports 21, 23 couple the helmet 17 to the shoulder pads 19. Each support is a rod or bar that extends from the helmet to the shoulder pads. In the preferred embodiment, the rod is of the turnbuckle type so as to be of adjustable length. This allows the protective apparatus 11 to be custom fitted to the wearer, wherein the distance between the helmet and the shoulder pads can be adjusted. Each support has a first end 99, a second end 25 and a turnbuckle 101. As the turnbuckle is rotated, the length of the support (as measured between the first and second ends 99, 25) is changed. The first end 99 of each rod is coupled to the exterior of the helmet shell by way of a mounting flange 103.

The second end 25 of the rear support 21 is coupled directly to the shoulder pads by way of a ball and socket joint 28 (see FIG. 4). The ball 105 is coupled to the second end 25 while the socket 107 is coupled to the bar 91. Alternatively, the ball could be coupled to the bar 91 and the socket could be coupled to the rear support 21. Fasteners 106 such as bolts and nuts are used to couple the flanges 103 to the helmet shell 35 and the socket joint 28 to shoulder pad bar 91.

The second ends 25 of the lateral supports 23 are coupled to the shoulder pads 19 by way of a roller assembly 109 and the channels 27 (see FIG. 3). Each of the second ends 25 of the lateral supports 23 has a roller assembly 109 located thereon. Each roller assembly 109 is pivotally coupled to the respective support. This allows the roller assembly to pivot (about the longitudinal axis of the support 23 between the first and second ends 99, 25) when traversing the arcuate shaped channels 27 shown in FIG. 1. In the preferred embodiment each roller assembly 109 has two rollers 113, with the attaching bracket 111 that couples the rollers to the respective lateral support, being located between the rollers. This arrangement provides for ease of movement of the roller assembly inside of the channel, as at least one of the rollers, instead of the support, contacts the channel side and bottom walls.

Each channel 27 is contained within a channel block 115. Referring to FIGS. 1–3, each channel block 115 is coupled to the top of the shoulder pads near the neck opening 97. The blocks extend between the front and back ends 85, 87. Flanges 117 are provided on each channel block 115 for coupling. Fasteners, such as bolts and nuts couple the flanges to the backing layer 83 of the shoulder pads 19. The channel blocks 115 may be solid. The channel 27 within each channel block has a bottom wall 119 and side walls 121. The channel 27 forms a groove or track for receiving and retaining the roller assembly 109 of the respective lateral support 23. The channels are arcuate so as to extend around a portion of the neck opening 97.

Referring to FIG. 1, the protective apparatus 11 of the present invention is donned by a human by the following steps. First, the shoulder pad buckle 95 is released and the front ends 85 of the shoulder pads are spread to widen the neck opening 97 (see FIG. 2). Then, the head 13 of a wearer is inserted through the neck opening from underneath the shoulder pads. The head continues into the helmet 17 until the head is located within the crown 29. The buckle 95 is then fastened to close the shoulder pads. Other straps may be provided to secure the shoulder pads to the body. The chin strap 45 is then secured around the chin.

When the protective apparatus of the present invention is worn, the head, neck and even shoulders of the wearer are protected. If the helmet 17 sustains an impact, then the force is transmitted to the shoulder pads 19 by their rear and lateral supports 21, 23. Thus, the shoulders, and not the head and neck, receive the brunt of the impact. The shoulders are better suited for such forces than are the head and neck. In addition, the impact force is distributed over a wider area when applied to both shoulders, rather than the single head or neck.

By using rear and lateral supports 21, 23, a wide variety of helmet impacts are transmitted to the shoulders. For example, impacts to the top of the helmet are transmitted to the shoulder pads by the rear and both lateral supports 21, 23. The impact is transmitted along the rear support 21 through the ball and socket joint 28, to the bar 91 and to the shoulder pads 19. The impact is transmitted along the lateral supports 23 through the rollers 113 to the bottom or side walls 119, 121 of the channel blocks 115 and to the shoulder pads 19. The provision of the flaps 47 on the crown 29 provide some flexibility in the crown to shell coupling. During an impact to the helmet, the flaps 47 may distort to minimize transference of the impact to the head through the crown. Thus, compression and axial loading neck injuries are minimized or even eliminated. Impacts to one side of the helmet are transmitted to the shoulder pads by one or more of the supports located on the opposite side of the helmet. Thus, hyperflexion and hyperextension neck injuries are minimized or even eliminated. In addition, helmet enhanced inertia injuries are minimized or even eliminated, because the helmet is coupled to the shoulder pads. Thus, it is unlikely for the helmet to develop inertia independently of the shoulder pads.

The helmet 17 may be moved from side-to-side relative to the shoulder pads 19. For example, as the helmet is moved to the wearer's right, the right lateral support causes the right roller assembly to traverse towards the rear of the right channel, while the left lateral support causes the left roller assembly to traverse towards the front of the left channel. The roller assemblies are free to pivot about the longitudinal axis of the respective lateral supports in order to follow the curved channels. The rear support 23 twists and pivots at the ball and socket joint 28 to accommodate the side-to-side movement of the helmet.

The ball and socket joint 28 of the rear support 21 also allows the helmet to be nodded up and down relative to the shoulder pads. For example, as the helmet is nodded up (or backwards), the rear support 21 pivots backwardly (with respect to the orientation of the wearer). The roller assemblies of the lateral supports are lifted from the bottom wall 119 of the channels 27.

In addition to movement of the helmet relative to the shoulder pads, the head 13 can be moved within the helmet 17. Side-to-side head movement is provided by the crown 29. Referring to FIG. 5, as the head moves to the right of the wearer, for example, the inner band 31 rotates accordingly. The inner band 31 is in contact with the head and moves relative to the outer band 33. When the head returns to the center position, with respect to the helmet, the springs 77 assist this movement by pulling the inner band back to its home position within the outer band. The wearer's eyes return to the center position with the helmet.

The head can also be moved up and down with the helmet by pivoting the crown 29 about the pins 53. For example, as the head is nodded down within the helmet, the front portion of the crown dips down while the rear portion of the crown raises up.

Side-to-side movement of the head can involve both helmet movement and head movement. Thus, as the head is turned to the side, the helmet can move with respect to the shoulder pads and the head can move inside of the helmet. Likewise, up and down movement can involve both helmet movement and head movement. For example, as the head is nodded up, the helmet can be nodded up and the crown can pivot.

The amount of helmet movement relative to head movement can be varied. For example, the amount of side-to-side movement of the helmet can be determined by the channels. If the length of each channel is short, then the amount of side-to-side helmet movement is limited. Also, if the channel is made narrow so that much friction is encountered between the roller assembly and the channel side walls, then the amount of helmet movement will be limited. In addition, the amount of side-to-side head movement within the helmet can be adjusted by the length of the slots 71 in the outer band 33 and by the strength of the tension forces produced by the spring 77. The amount of up and down helmet movement is determined by the ball and socket joint and by the depth of the channel. A stiff or tight ball and socket joint 28 minimizes helmet movement. Deep channels allow the helmet to be nodded downwardly to a greater extent than shallow channels. The amount of up and down head movement within the helmet is determined by the tightness of the coupling of the pins to the helmet. If the crown can rotate relatively free of friction, then the crown will move more easily within the shell 35.

The foregoing disclosure and the showings made in the drawings are merely illustrative of the principles of this invention and are not to be interpreted in a limiting sense.

I claim:

1. A protective apparatus for use by a human, comprising:

a) a helmet, said helmet having sides and a rear;

b) shoulder pads, said shoulder pads having a track coupled thereto;

c) a lateral support located on each side of said helmet, each of said lateral supports having a first end and a second end, each of said lateral support first ends being coupled to said helmet sides, each of said lateral support second ends being located in said track;

d) a rear support having first and second ends, said rear support first end being coupled to said rear of said helmet, said rear support second end being coupled to said shoulder pads by way of a ball and socket joint.

2. The protective apparatus of claim 1, wherein:

a) said shoulder pads further comprising a first shoulder pad and a second shoulder pad, with each of said first and second shoulder pads having a first end and a second end;

b) a rear member extends between said first shoulder pad first end and said second shoulder pad first end, said rear member being coupled to said first shoulder pad first end and said second shoulder pad first end;

c) said ball and socket joint comprising a ball portion and a socket portion, with one of said ball portion and said socket portion being coupled to said rear member and the other of said ball portion and said socket portion being coupled to said rear support second end.

3. The protective apparatus of claim 2 further comprising a first strap coupled to said first shoulder pad second end and a second strap coupled to said second shoulder pad second end, said first and second straps being coupled together by a buckle.

4. The protective apparatus of claim 1, wherein:

a) each of said lateral support second ends comprises a roller;

b) said track comprises a channel, said channel receiving said respective rollers.

5. A protective apparatus for use by a human, comprising:

a) a helmet having sides and a rear;

b) shoulder pads, said shoulder pads comprising a first shoulder pad and a second shoulder pad, said first and second shoulder pads forming a neck opening, said first and second shoulder pads each having a channel located therein, each of said channels extending around a portion of said neck opening, each of said'shoulder pads having first and second ends, said shoulder pad first ends being coupled together;

c) a support located on each side of said helmet, each of said supports having a first end and a second end, each of said support first ends being fixedly coupled to one of said sides of said helmet, each of said support second ends being coupled to a roller, each of said rollers being located in one of said respective channels.

6. The protective apparatus of claim 5 wherein each of said first and second shoulder pads further comprise a channel block coupled thereto, each of said channels being located in said respective channel block.

7. The protective apparatus of claim 6 wherein each of said first and second shoulder pads comprise pads and a backing layer located adjacent to said pads, each of said channel blocks being coupled to said backing layer of said respective first and second shoulder pads.

8. A protective apparatus for use by a human, comprising:

a) a helmet, said helmet comprising a shell and a crown;

b) said shell being hard and having side walls and a front opening;

c) said crown comprising a headband and a top piece, said top piece being structured and arranged to fit on a top of a head of said human, said top piece being coupled to said headband;

d) said headband having no more than two pins extending outwardly from said headband, each of said pins having an outer free end, each of said pins extending through one of said side walls of said shell such that said shell is located between said outer end of each pin and said headband, each of said pin outer ends receiving a retainer, wherein said pins allow said headband and said top piece to pivot within said shell.

9. A protective apparatus for use by a human, comprising:

a) a helmet that comprises a shell and a crown located inside of said shell;

b) said shell being hard and having sides, a rear and a front opening;

c) said crown comprising an inner band and an outer band, each of said bands forming a loop, said inner band being located within said outer band, said inner band being rotatably coupled to said inner band;

d) said outer band having two pins extending outwardly therefrom, each of said pins having an outer free end, each of said pins extending through one of said sides of said shell such that said shell is located between said outer end of each pin and said outer band, each of said pin outer ends receiving a retainer, wherein said pins allow said crown to pivot within said shell;

e) shoulder pads, said shoulder pads comprising a first shoulder pad and a second shoulder pad, with each of said first and second shoulder pads comprising pads and a backing layer located adjacent to said pads, with each of said first and second shoulder pads having a first end and a second end;

f) a rear member extending between said first shoulder pad first end and said second shoulder pad first end, said rear member being coupled to said first shoulder pad first end and said second shoulder pad first end;

g) means for coupling said first shoulder pad second end to said second shoulder pad second end;

h) a channel block coupled to said backing layer of each of said first and second shoulder pads, each of said channel blocks having a channel formed therein;

i) a rear support having first and second ends, said rear support first end being coupled to said rear of said helmet shell, said rear support second end being coupled to said rear member by way of a ball and socket joint;

j) a lateral support located on each side of said helmet, each of said lateral supports having a first end and a second end, each of said first support first ends being coupled to said shell, each of said lateral support second ends having a roller that is located in said channel.

10. The protective apparatus of claim 8 wherein said headband further comprises spacer flaps that extend outwardly from said headband, each of said pins being coupled to said headband by way of one of said spacer flaps.

11. The protective apparatus of claim 8 wherein said headband comprises an inner band and an outer band, said outer band being coupled to said shell by said pins, said inner band being coupled to said top piece, said inner band having means for rotatably coupling to said outer band such that said inner band rotates within said outer band.

12. The protective apparatus of claim 8 further comprising:

a) first and second shoulder pads, said first and second shoulder pads forming a neck opening, said first and second shoulder pads each having a channel located therein, each of said channels extending around a portion of said neck opening;

b) a support located on each side of said shell, each of said supports having a first end and a second end, each of said support first ends being coupled to one of said side walls of said shell, each of said support second ends being coupled to a roller, each of said rollers being located within one of said respective channels.

13. A protective apparatus for use by a human, comprising:

a) a helmet, said helmet comprising a shell and a crown, said crown being located inside of said shell;

b) said shell being hard and having side walls and a front opening;

c) said crown comprising an inner band and an outer band, each of said inner and outer bands forming a loop, said inner band being located within said outer band;

d) means for rotatably coupling said inner band to said outer band, wherein said inner band is rotatable within said outer band;

e) said means for rotatably coupling said inner band to said outer band further comprises a projection and a guide slot arrangement, wherein one of said inner or outer bands has said guide slot extending circumferentially around a portion of said one of said inner or outer bands, and the other said inner or outer bands has said projection extending therefrom and through said guide slot, wherein said projection moves within said guide slot when said inner band moves relative to said outer band.

14. The protective apparatus of claim 13 further comprising a spring, said spring having first and second ends and a middle portion, said spring first end being coupled to said one of said inner or outer bands having said guide slot at a location near a first end of said guide slot, said spring second end being coupled to said one of said inner or outer bands having said guide slot at a location near said second end of said guide slot, said spring middle portion being coupled to said projection.

15. The protective apparatus of claim 14 further comprising a top piece coupled to said inner band, said top piece being structured and arranged to fit on top of a head of said human.

* * * * *